US008603605B2

(12) United States Patent
Dretzka

(10) Patent No.: US 8,603,605 B2
(45) Date of Patent: Dec. 10, 2013

(54) CONTOUR SINK MAT

(75) Inventor: Philip C. Dretzka, Woodbury, MN (US)

(73) Assignee: Interdesign, Inc., Solon, OH (US)

( * ) Notice: Subject to any disclaimer, the term of this patent is extended or adjusted under 35 U.S.C. 154(b) by 206 days.

(21) Appl. No.: 13/136,985

(22) Filed: Aug. 16, 2011

(65) Prior Publication Data

US 2013/0045356 A1 Feb. 21, 2013

(51) Int. Cl.
*A47L 19/02* (2006.01)
*B32B 3/10* (2006.01)

(52) U.S. Cl.
USPC ..... 428/81; 428/131; 4/657

(58) Field of Classification Search
USPC ..... 428/81, 131; 4/657, 655, 654, 581
See application file for complete search history.

(56) References Cited

U.S. PATENT DOCUMENTS 5,815,856 A 10/1998 Dore
7,325,694 B2 * 2/2008 Bushey ..... 210/499

OTHER PUBLICATIONS

2009 InterDesign, Inc. product brochure, pp. 65, 66, 67, 68, & 70 (with front and back covers).

* cited by examiner

*Primary Examiner* — Alexander Thomas
(74) *Attorney, Agent, or Firm* — D. Peter Hochberg; Sean F. Mellino

(57) ABSTRACT

A sink mat made of soft, pliable material comprising a set of slits defining flaps in said sink mat enabling said sink mat to fit in a sink smaller than said sink mat and for the flaps to curve against the walls of said sink and overlap and lie flat against each other.

2 Claims, 2 Drawing Sheets

CONTOUR SINK MAT

BACKGROUND OF THE INVENTION

1. Field of the Invention

The present invention relates to sink mats for protecting dishes and glasses from being broken when being put into or taken from sinks and to protect the sinks from chipping or being scratched, and in particular to sink mats for use in different sizes and shapes of sinks.

2. Description of the Prior Developments

Sink mats are well known, particularly for use in kitchens. Sink mats both protect porcelain and other coated sinks from chipping and for protecting metal sinks from being scratched by dishware, cookware and dinnerware in the sinks, as well as to protect dinnerware from being broken when disposed in sinks. Sinks come in many sizes, and many sinks are in use which are double sinks, one adjacent the other. Various means are known for adapting sink mats to accommodate these different types of sinks. The simplest way is to protect a sink is to put a sink mat in the sink, hoping that it will lie flat in the sink. If the sink mat is too small, the edges of the sink extending from beneath the sink mat are prone to the damage referred to above. If the sink mat is too large for the sink, the sink mat folds over on itself, both decreasing the size of the sink and leading to problems for the space between the folds in the sink mat and the sink base and walls. Products are on the market having different size sink mats, but this requires the buyer to measure the sink or sinks, and then look for mats which nearly exactly meet those sizes in order to lie flat in the sinks. It is also known in the art to take purchased sink mats, which are too large for particular sinks, and to cut them down to meet the size of the sink. This is, in effect, customizing the sink mat for particular sinks. This requires time and some care to properly customize the sink mat, and a mistake in the cutting could require the purchase of a new sink mat. There are on the market Circo trimmable sink mats which are particularly designed to be cut and custom fit to particular sizes of sinks, but this incorporates the same shortcomings noted above. In addition, while many sinks have square or rectangular bases, some sinks are bowl-shaped or have irregular configurations which render customizing of sink mats more difficult.

U.S. Pat. No. 5,815,856 (Dore 1998) discloses a soft, pliable mat having a rectangular base and four rectangular flaps which extend up the walls of the sink and onto the surrounding countertop or dividing wall with a second sink. This sink mat thus has four large flaps which, while perhaps solving their intended purpose of protecting the entire sink and the surrounding countertop from excessive wear and a tendency to become grimy from greasy hands as well as being a splash-guard, it does have serious disadvantages. First, it would be unsightly to have such a large sink mat remain in the sink because it not only covers the sink but the countertop and any walls around the sink. Furthermore, if it were left in place, any water or dirt left beneath the flaps would be unhygienic and unsightly when the mat is lifted up. Additionally, the exterior and downwardly-facing sides of the respective mats would have to be cleaned since water from the faucet would not rinse them off during use. Moreover, storage of such a mat would be a problem since each flap would have to be folded or rolled, and a storage space would be required to store this mat in its compacted condition.

What is needed is a single sink mat which could be placed in virtually every sink, lies flat against the base of the sink, automatically becomes configured to engage the walls of any sink having a base too small to receive the entire mat against its base and is able to engage a portion of the walls of the sink without being folded. Such a sink mat could thus come in a single size, would serve all of the purposes of sink mats as noted above, and would require no more than simply purchasing the mat—no cutting would be required. The desired mat should be soft and pliable to render its protective purposes, have sufficient apertures for the desired drainage, and preferably would be both long lasting and inexpensive.

SUMMARY OF THE INVENTION

An object of the present invention is to provide an improved sink mat for protecting sinks from damage caused by objects placed therein and to protect the objects placed in the sink from being damaged.

Another object of the present invention is to provide a sink mat which can effectively engage the base of a sink in which it is placed, and the walls of the sink meeting the base of the sink in those situations where the sink mat is larger than the base of the sink.

A further object of the present invention is to provide a sink mat which lies flat against the base of a sink in which it is placed, and in those situations where the sink mat is larger than the base of the sink, it extends up the walls of the sink while substantially engaging those walls and not folding over on itself so as to limit its intended purpose.

Yet a further object of the present invention is to provide an improved sink mat which can effectively engage the base and walls of sinks having bases which are not of square or rectangular configuration, without requiring any cutting of the sink mat.

It is yet still another object of the present invention to provide an improved sink mat as discussed above which can be easily manufactured using known manufacturing techniques, is soft and pliable, and efficient in operation and economical to manufacture for sale at a reasonable price.

These and other objects will be apparent from the description to follow and from the appended claims.

DETAILED DESCRIPTION OF THE INVENTION

Figure 3:
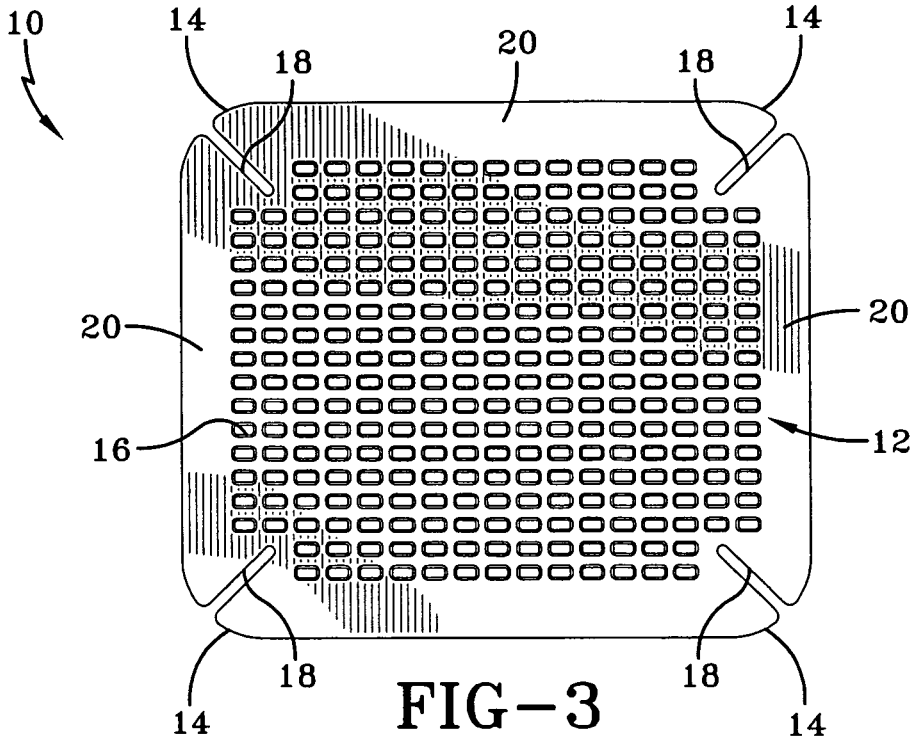
FIG. 3 is a bottom view of the sink mat shown in FIGS. 1 and 2.
Figure 2:
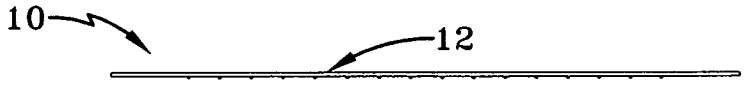
FIG. 2 is a side view of the sink mat shown in FIG. 1.
Figure 1:
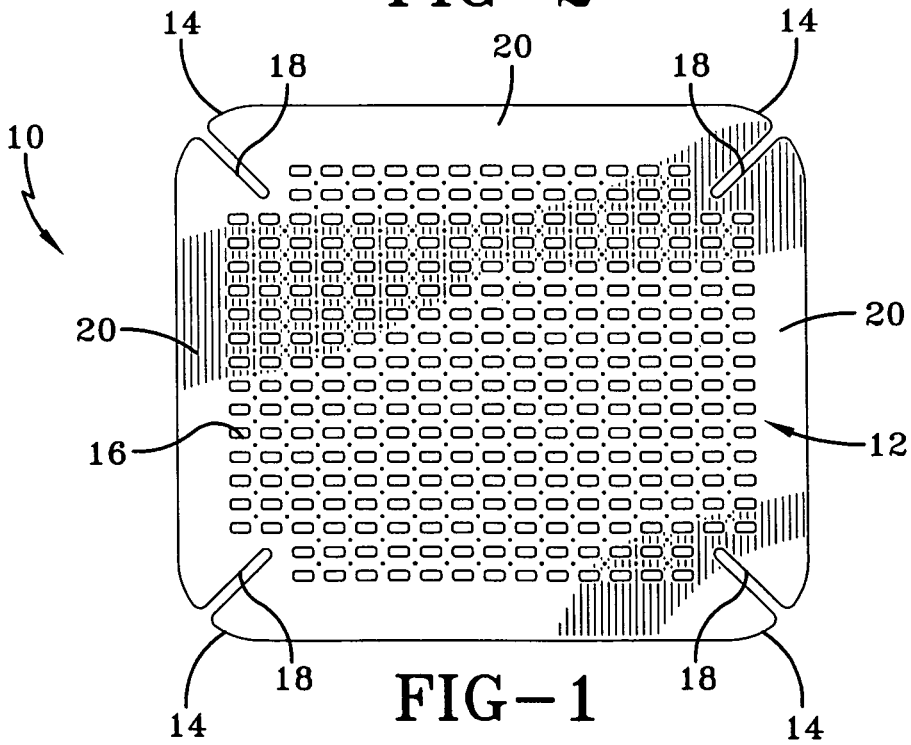
FIG. 1 is a top plan view of a sink mat according to the preferred embodiment of the invention.

Referring to FIGS. 1, 2 and 3, a contour sink mat 10 is shown. Contour sink mat 10 includes a body portion 12 which is generally rectangular in configuration, having generally rounded corners 14. Extending through sink mat 10 are a series of apertures 16 which are shown as arranged in linear rows and columns, although this is not necessary. Apertures 16 are provided for draining water and any waste product from dishware, cookware and dinnerware placed thereon into a drain.

Contour sink mat 10 further has a series of corner slots 18 extending through each generally-rounded corner 14 to divide corners 14 into symmetrical halves, and help define a set of flaps 20. The depth of flaps 20 are determined by the lengths of each corner slot 18. Apertures 16 are spaced from corner slots 18 so as to avoid any weakened areas which could occur due to overlapping of the halves of rounded corners 14 if contour sink mat 10 is placed into a sink which is smaller in area than is the area of contour sink mat 10.

Contour sink mat 10 should be soft and pliable. The material which has been found to be appropriate for sink mat 10 is polyvinyl chloride (PVC) 60-65 durometer. That is, this material is soft, as indicated by the Shore A scale 60-65. Sink mat 10 could be in any color, and oftentimes it is clear so that the sink beneath or behind it is entirely visible.

Figure 4:
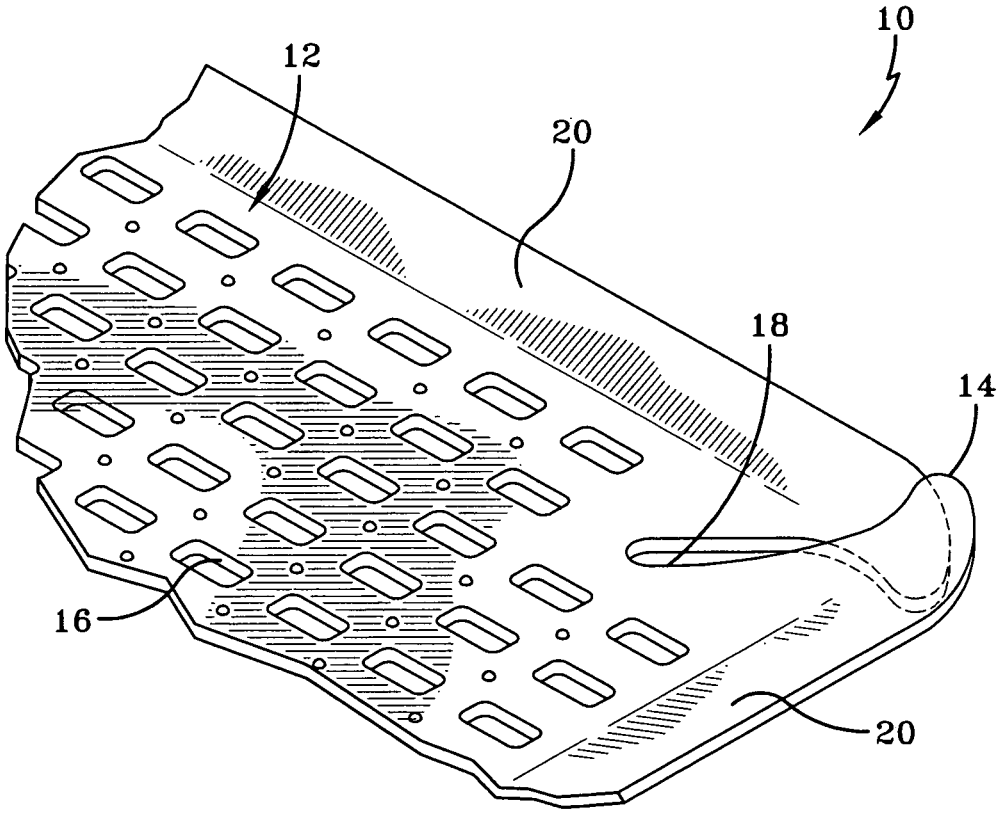
FIG. 4 is a perspective view of a corner of the sink mat shown in FIGS. 1-3 located in a sink smaller than the sink mat.

In use, contour sink mat 10 is placed in the sink. If the sink is as large or larger than the sink mat 10 and is flat, contour sink mat 10 simply sits flat on the base of the sink. If the sink base is generally rectangular in configuration and matches the shape of sink mat 10 but is somewhat smaller, flaps 20 fold, roll or curve up along the sides of the sink. If the sink is so small that the width of the respective slots 18 becomes too small for there to be a space between the sides of each slot 18, one edge of slot 18 would fall over the other edge of slot 18 as shown in FIG. 4. However, the overlapping edges of adjacent flaps 20 at respective slots 18 would lie flat against each other, rather than having the disadvantageous folds of the prior art. If the sink in which contour mat 10 is placed has a bowl shape or some other irregular shape, contour sink mat 10 should bend accordingly, and adjacent edges of flaps 20 may overlap but be flat against each other to engage the surface of the sink and perform the intended function mat 10.

Contour sink mat 10 has been found to be effective with the rectangular configuration as shown in FIGS. 1-3. It may be advantageous for particular sinks to change the contour of sink mat 10 accordingly, but still including slits in appropriate places to enable sink mat 10 to engage the surfaces of the sink when the sink base is smaller than mat 10, with the flat overlap discussed above. Thus, contour sink mat 10 could be rectangular, circular or have some other configuration.

As noted above, the material is preferably PVC 60-65 durometer. A thickness which has been found to be effective is 0.32 inch. Contour sink mat 10 has been found to be effective for most sinks having the general shape of a rectangle, with a long side being 16.00 inches and the short side being 14.00 inches. The corners between the exterior surface of flaps 10 and the sides of corner slots 18 have been found to be effective with a radius of 0.25 inch. The width of slots 18 has advantageously been determined to be 0.25 inches. Apertures 16 have been found to be effective with a long side being 0.51 inch and the short side being 0.25 inch. Apertures 16 preferably would have rounded corners with a radius of 0.07 inch. The distance between the short sides of apertures 16 has preferably been found to be 0.30 inch, and the distance between long sides has been determined to be advantageously 0.37 inch. The radius of each corner 14 has been determined to be 2.25 inches. The perpendicular distance between the end of each slot 18 and the exterior edge of each flap 20 is preferably 2.29 inches. As mentioned above, the details of the length and width of corners 14 may change in appropriate situations, and the size, shape and location of apertures 16 may vary as well. Other forms of draining water through apertures may be appropriate in some situations as well.

Contour sink mat 10 can be produced using ordinary manufacturing methods. Die molding would be an effective way of manufacturing the mat as shown.

The invention has been described in detail with particular reference to the preferred embodiment above, but variations and modifications may occur to those skilled in the art from the foregoing description and from the appended claims.

I claim:

1. A sink mat comprising:

a soft and pliable body portion configured to fit into a sink, said body portion having a rectangular configuration with four rounded corners and exterior edges extending along the rectangular portion and around said respective four corners a set of straight slots extending inwardly from said spaced exterior edges along said respective four rounded corners of said sink mat to define flaps around said sink mat, said straight slots dividing said respective corners into symmetrical halves, said straight slots consisting respectively of a single straight slot; and a set of apertures disposed across said sink mat, each of said apertures consisting of rectangular apertures for draining water;

wherein said flaps bend when said sink mat is placed in a sink smaller than said sink mat, said flaps curving over each other at said respective slots when forced to do so by the walls of the sink in which said sink mat has been placed, and wherein said sink mat is devoid of any openings other than said set of slots and said set of apertures.

2. A sink mat according to claim 1 wherein said sink mat is made of PVC 60-65 durometer.

* * * * *